United States Patent [19]

Jantz

[11] Patent Number: 4,985,949

[45] Date of Patent: Jan. 22, 1991

[54] INFANT CARRIER SEAT ROCKER

[76] Inventor: Robert F. Jantz, 9 Maverick Cir., Pomona, Calif. 91766

[21] Appl. No.: 402,468

[22] Filed: Sep. 1, 1989

[51] Int. Cl.[5] ..... A47D 9/02

[52] U.S. Cl. ..... 5/109; 5/107

[58] Field of Search ..... 5/105, 107, 108, 109

[56] References Cited

U.S. PATENT DOCUMENTS

| | | | |
|---|---|---|---|
| 3,022,520 | 2/1962 | Finger | 5/109 |
| 3,225,365 | 12/1965 | Miller | 5/109 |
| 3,653,080 | 4/1972 | Hafele | 5/108 |
| 3,851,343 | 12/1974 | Kinslow, Jr. | 5/109 |
| 4,371,206 | 2/1983 | Johnson | 5/108 |
| 4,656,680 | 4/1987 | Wilson | 5/109 |

FOREIGN PATENT DOCUMENTS

| | | | |
|---|---|---|---|
| 1294774 | 3/1961 | France | 5/109 |

*Primary Examiner*—Gary L. Smith
*Assistant Examiner*—F. Saether

[57] ABSTRACT

An improved infant carrier seat rocker is provided for a typical molded plastic type infant carrier seat embodying a rounded bottom to facilitate a fore and aft rocking motion. This type of seat is currently in production. The rocker is comprised of a housing from which a lifting member protrudes. A power unit is mounted within the housing. This power unit provides rotational energy. A drive means consisting of an eccentric mounted to the output of the drive unit and slidably connected to the lifting member to convert rotational energy to vertically reciprocating motion is employed to impart the vertical motion to the lifting member. The lifting member in turn imparts this motion to a suitable feature of the carrier seat, typically the lower edge of the seat, and the seat then rocks as the lifting member oscillates vertically.

3 Claims, 8 Drawing Sheets

INFANT CARRIER SEAT ROCKER

BACKGROUND

1. Field of Invention

This invention relates to rocking devices, specifically, to such rocking devices which are used to automatically rock a typical molded plastic type infant carrier seat.

2. Description of Prior Art

Infant carrier seats of the kind currently being produced are generally comprised of a one piece molded plastic body. One common feature of this body is a rounded base to facilitate a fore and aft rocking motion of the seat.

The intent of this rocking motion is to sooth and relax the infant residing within the carrier seat. Normally this rocking motion is imparted to the seat by someone manually rocking the seat by grasping typically the lower edge of the seat, the edge nearest the infants feet, and moving it gently up and down thereby rocking the seat on its rounded bottom.

A desireable alternative to this would be to have a device which would rock the carrier seat automatically.

A rocking device of this type has been proposed in U.S. Pat. No. 3,851,343 (1973) to Kinslow, Jr.. Although the device as described does rock a particular infant seat, it suffers from a number of disadvantages:

(a) The device is cumbersome. To implement the device may prove too time consuming for the user, thereby possibly limiting its own use.

(b) The device is comprised almost entirely of parts requiring custom fabrication. This makes the device costly to manufacture.

(c) The device requires that modifications be made to the infant seat before it can be used with the rocking device. These modifications include attaching a special framework, links and rods to the seat. However these modifications are not readily adaptable to present day infant seats thereby rendering this type of rocking device obsolete.

OBJECTS AND ADVANTAGES

Accordingly, several objects and advantages of my invention are:

(a) to provide an infant carrier seat rocker device which is small, and is simple to use and operate.

(b) to provide an infant carrier seat rocker device which will be comprised of a reduced number of pieces requiring custom fabrication thereby making it less costly to manufacture.

(c) to provide an infant carrier seat rocking device which will work with the type of carrier seat currently being produced.

(d) to provide an infant carrier seat rocking device which will require no modifications of the infant carrier seat to which it will rock.

(e) to provide an infant carrier seat rocking device having fewer parts than the prior art design yet providing all aforementioned advantages.

Still further objects and advantages will become apparent from a consideration of the ensuing description and drawings.

DESCRIPTION OF INVENTION

Figure 1:
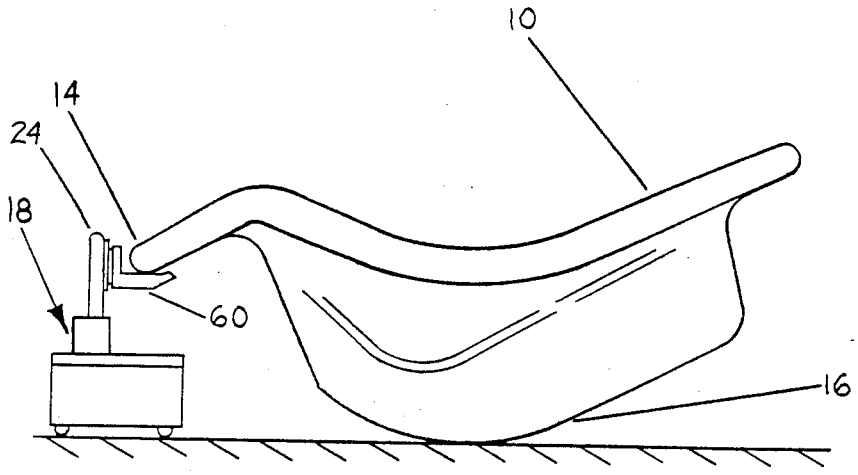
FIG. 1 is a side view of the infant carrier seat and the device for rocking the seat.
Figure 2:
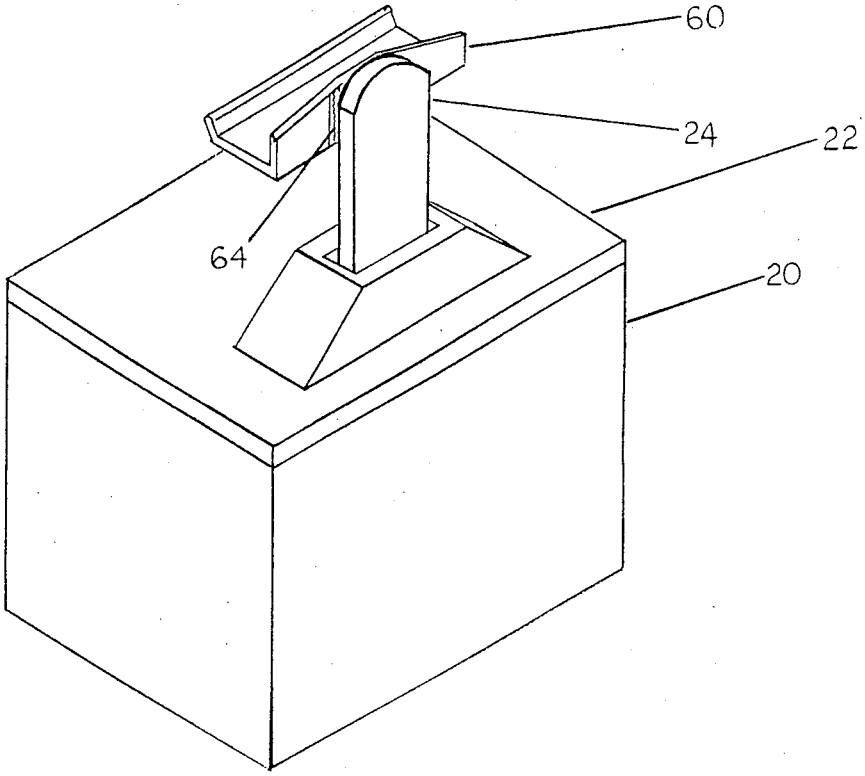
FIG. 2 is a perspective view of the rocking device.
Figure 3:
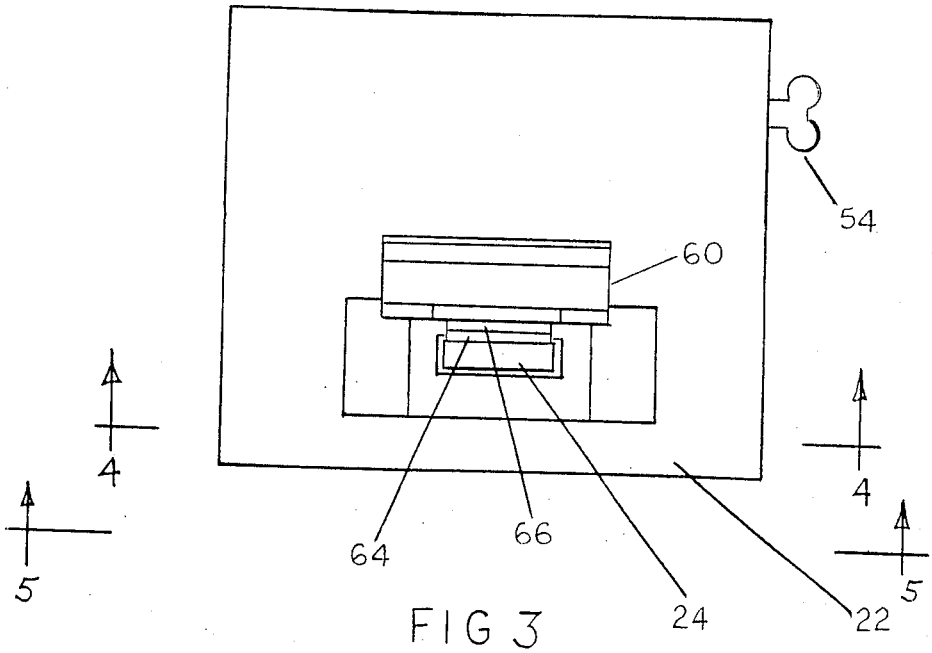
FIG. 3 is a top view of the rocking device.
Figure 4:
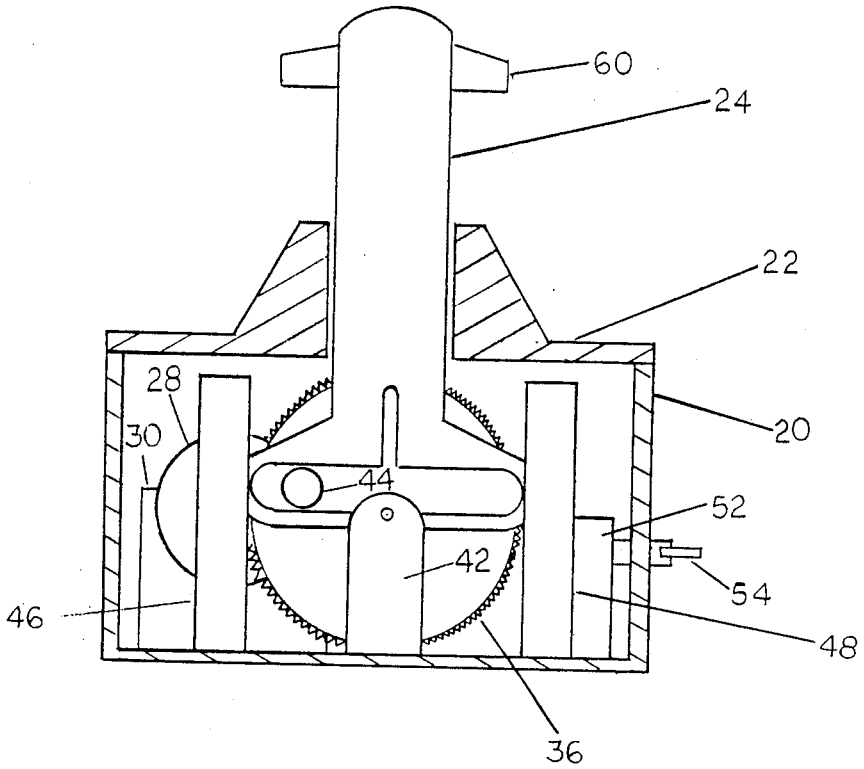
FIG. 4 is a sectional view taken on the line 4—4 of FIG. 3.
Figure 5:
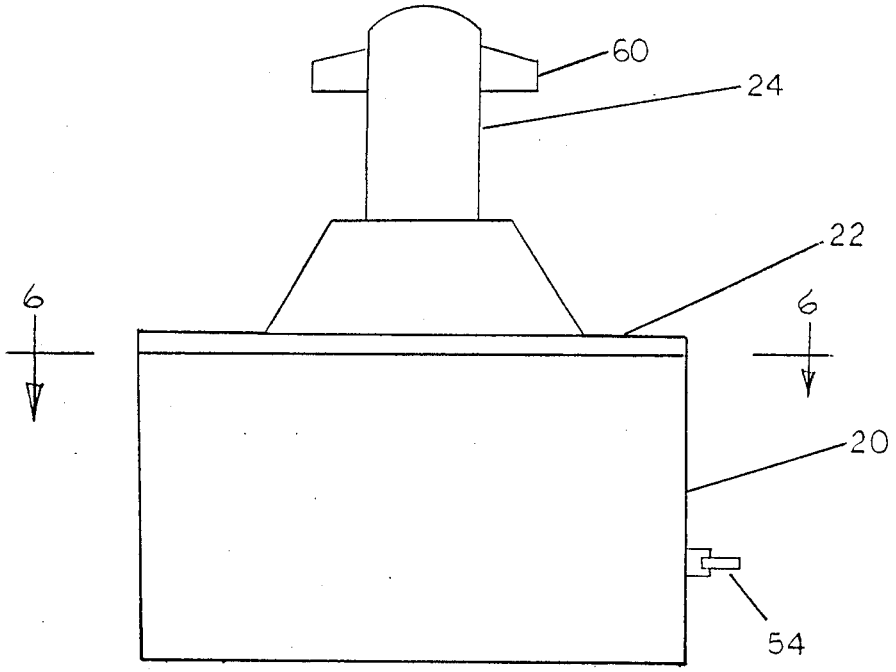
FIG. 5 is a side view taken on the line 5—5 of FIG. 3.
Figure 6:
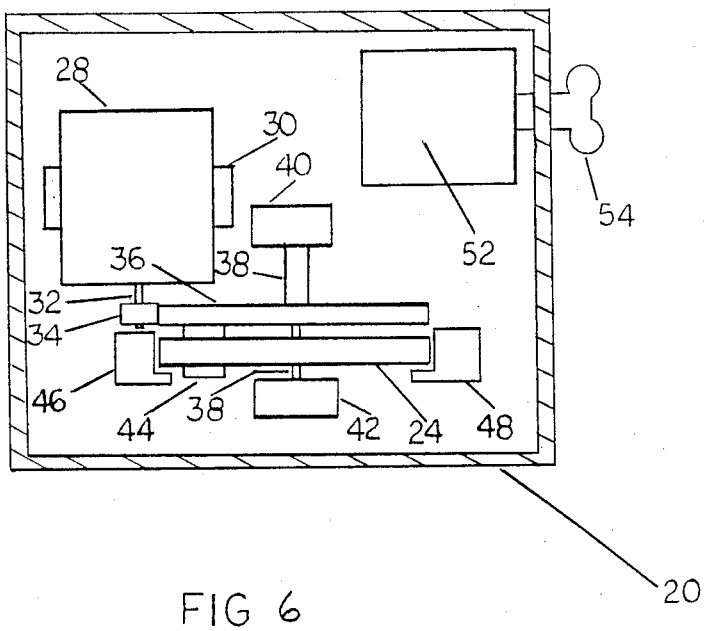
FIG. 6 is a sectional view taken on the line 6—6 of FIG. 5.
Figure 7:
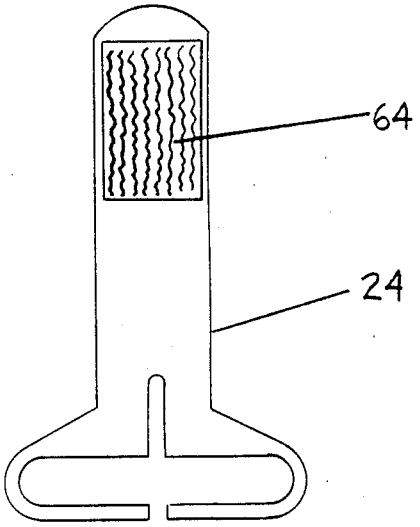
FIG. 7 is a detail drawing.
Figure 8:
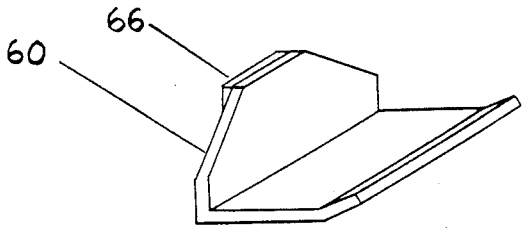
FIG. 8 is a detail drawing.

FIG. 1 shows a side view of my device 18 in conjunction with a typical molded plastic infant carrier seat 10 having a rounded bottom 16 and whose front lower edge 14 is resting on the lifter tray 60 of the rocking device 18.

The rocking device 18 embodies a cover 22 and a housing 20 to which mounting bracket 30, yoke guides 46 and 48, bosses 40,42 and 54 are attached. The mounting bracket 30 holds in place a power unit 28 which comprises a commercially available spring or electric motor geared to operate its drive shaft 32 at a comfortable rate for the infant residing in the infant carrier seat 10. Mounted to the drive shaft 32 is a drive pinion 34 which meshes with a drive gear 36. Drive gear 36 is mounted on a shaft 38 whose diameter is reduced in size enabling it to pass through the smaller slot in lifter yoke 24. The ends of shaft 38 are free to rotated in bossed 40 and 42. A drive pin 44 is attached to the drive gear 36. The drive pin 44 is sized so that it moves freely in the larger of the two slots in lifter yoke 24. The lifter yoke 24 fits over the drive pin 44 and is held in its relative horizontal position by yoke guides 46 and 48 which are spaced far enough apart horizontally so as not to impede a vertical movement of lifter yoke 24. Attachment of lifter tray 60 to lifter yoke 24 is performed using a hook and loop type fastener. The hook portion 64 is attached to lifter yoke 24 and the loop portion 66 is attached to lifter tray 60. Pressing lifter tray 60 together with lifter yoke 24 adjoins the two parts.

The device may also include means for producing music if desired by the user. A commercially available wind-up music producer 52 is mounted to the housing 20 with its wind up stem 54 protruding through the housing 20.

OPERATION OF INVENTION

As shown in FIGS. 1 through 8, front lower edge 14 of carrier seat 10 rests in lifter tray 60 of rocker device 18. The rocking motion of carrier seat 10 is imparted to the seat by a vertical oscillation of lifter yoke 24 to which lifter tray 60 is attached.

This vertical oscillation of lifter yoke 24 is achieved by having drive pinion 34 drive drive gear 36 to which drive pin 44 is attached. This drive pin, traveling in a circular motion, and in the larger of the two slots in lifter yoke 24 causes a vertical oscillating motion in the drive yoke as it is held horizontally in place by yoke guides 46 and 48 whose horizontal spacing is such that they do not impede the vertical motion.

The smaller slot in lifter yoke 24 is provided for clearance of shaft 38 as driver yoke 24 travels its vertical path. The diameter of drive pin 44 is such that it travels freely in the larger of the two slots in lifter yoke 24 yet does not bind as it passed over the smaller slot opening of lifter yoke 24.

The lifter tray 60 is fastened to lifter yoke 24 using hook and loop type fastener 64 and 66. This type of fastener allows for easy vertical adjustment of lifter tray 60 relative to the height of lower front edge 14 of seat 10. This allows for rocker device 18 to be adaptable to a variety of different manufactured carrier seats. Lifter tray 60 should be adjusted so that with the infant in the seat there is always a downward force on the lifter tray. This is because the rocker device provides an upward pushing force and movement to the edge of the carrier seat as the lifter tray has no provision for pulling the seat edge.

Thus the reader will see that the infant carrier seat rocker of this invention provides a simple, compact, easy to use device which can be used by persons of almost any age. Furthermore, the rocker device of this invention has additional advantages in that (1) it requires no modifications to the seat which it will rock, (2) it will work with the type of seats currently being produced, (3) it is a small, compact unit, (4) it requires a fewer number of parts than the prior art designs and is applicable to a wider variety of seats, (5) its housing design lends itself to current plastic molding techniques and (6) it is easy to implement and no complicated setup is involved.

While my above description contains many specificities, these should not be construed as limitations on the scope of the invention, but rather as an exemplification of one preferred embodiment thereof. Many other variations are possible. For example, the rocker device could become an integral part of a new "self-contained" automatically rocking infant carrier seat. The device could also interface with the "head" end of the seat.

Accordingly, the scope of the invention should not be determined by the embodiments illustrated, but by the appended claims and their legal equivalents.

I claim:

1. An improved rocking device for a typical infant carrier seat having a convexly curved bottom upon which said seat naturally rests to facilitate a fore and aft rocking motion and a pair of opposed identical side walls and outwardly curved external lips formed at the uppermost edge of the head and foot ends of said seat; said rocking device rests on a common plane with said seat and comprises:

a vertical lifter yoke for vertical oscillatory motion, a lifter tray removably receiving one of said external lips of said seat and is adjustably attached to said lifter yoke by a hook and loop type fastener, thereby providing for a plurality of attachment positions of said lifter tray relative to said lifter yoke, a drive means for oscillating said lifter yoke, said drive means including a motor with an output shaft and a drive pin eccentrically connected to said shaft, said pin being free to slidably move through a horizontally oriented slot in said lifter yoke thereby producing said vertical oscillating motion in said lifter yoke, a housing surrounding said drive means and part of said lifter yolk so that the part of said lifter yolk not within said housing is exposed to receive said lifter tray.

2. The device of claim 1 wherein said lifter tray is hook shaped and engages a underside of one of said lips of said seat.

3. The device of claim 1 wherein the speed of said oscillatory motion is adjustable.

* * * * *